US010603949B2

(12) United States Patent
Lehnhardt et al.

(10) Patent No.: US 10,603,949 B2
(45) Date of Patent: Mar. 31, 2020

(54) PEN FOR WRITING AND DRAWING PURPOSES

(71) Applicant: FABER-CASTELL AG, Stein (DE)

(72) Inventors: Ralf Lehnhardt, Mainleus (DE); Gunter Andree, Hamburg (DE); Manuel Haubner, Naila (DE)

(73) Assignee: Faber-Castell AG, Stein (DE)

( * ) Notice: Subject to any disclaimer, the term of this patent is extended or adjusted under 35 U.S.C. 154(b) by 0 days.

(21) Appl. No.: 16/042,021

(22) Filed: Jul. 23, 2018

(65) Prior Publication Data

US 2019/0039405 A1 Feb. 7, 2019

(30) Foreign Application Priority Data

Aug. 1, 2017 (EP) ..... 17184352

(51) Int. Cl.

| | |
|---|---|
| ***B43K 8/00*** | (2006.01) |
| ***B43K 24/08*** | (2006.01) |
| ***B43K 5/00*** | (2006.01) |
| ***B43K 7/00*** | (2006.01) |
| ***B43K 7/12*** | (2006.01) |
| ***B43K 25/02*** | (2006.01) |

(52) U.S. Cl.

CPC ..... *B43K 24/082* (2013.01); *B43K 5/005* (2013.01); *B43K 7/005* (2013.01); *B43K 7/12* (2013.01); *B43K 8/003* (2013.01); *B43K 25/028* (2013.01)

(58) Field of Classification Search

CPC ..... B43K 24/02; B43K 24/08; B43K 24/082; B43K 25/028

USPC ..... 401/104, 105, 106

See application file for complete search history.

(56) References Cited

U.S. PATENT DOCUMENTS 8,096,722 B2 * 1/2012 Rolion ..... B43K 7/005 401/104

* cited by examiner

*Primary Examiner* — David J Walczak
*Assistant Examiner* — Joshua R Wiljanen
(74) *Attorney, Agent, or Firm* — Laurence A. Greenberg; Werner H. Stemer; Ralph E. Locher

(57) ABSTRACT

A pen for writing and/or drawing purposes, and having a shaft and a core which is arranged within the shaft and is axially adjustable in the longitudinal direction of the shaft between an active position and an inoperative position. The core is completely arranged within the shaft in the inoperative position and projects with an overhang from a front end of the shaft in the active position. An actuating element is provided which is movable perpendicularly to the longitudinal direction of the shaft between an active position and an inoperative position and which is operatively connected to the core via a connecting element in such a way that, during a movement of the actuating element perpendicularly to the longitudinal direction of the shaft between the inoperative position and the active position, the core is axially adjustable in the longitudinal direction of the shaft.

17 Claims, 13 Drawing Sheets

6b
6c
16
4c
2
6a
6
4b
4a
L
40,36
14a
10a
14
14b
10
20,22
12b
D,30,F
12
20
B
62
12a
10b
26b 6b
6c
4c 16
2
4a
4b
6
6a
L
10
14
10a
B
12b
12a
20,22
12
20
F,D,30
10b
62

6b
6c
16
4c
2
6
6a
4a
L
14a
40,36
10a
14
10
20,22
12b
12a
12
D,30,F
62
B
49
10b 6b
6c
16
4c 6
6a
4b
2
4a
L
20,22
10
40,36
14
10a
12b
12a
D,30,F
12
20
49
10b
B

PEN FOR WRITING AND DRAWING PURPOSES

BACKGROUND OF THE INVENTION

Field of the Invention

The invention relates to a pen for writing and/or drawing purposes having a shaft and a core which is arranged within the shaft and which is axially adjustable in the longitudinal direction of the shaft between an active position and an inoperative position.

Pens in which the core is adjusted mechanically between an active position and an inoperative position are known in multiple embodiments and are used for example as ballpoint pens. In the case of so-called twist pens or twist ballpoint pens, a rear portion of the shaft is twisted with respect to a front portion in order to axially adjust the core. A further possibility is provided by push-type pens, for example push-type ballpoint pens, which have at their rear end an actuating button or pushbutton by the actuation of which the core is moved between the active position and the inoperative position. Here, the forward travel of the core is achieved, for example, by means of a spindle drive or a thread, with the result that a rotary movement of the shaft or a movement of the actuating button in the longitudinal direction of the shaft is transmitted to the core and the latter is thus axially adjusted. However, such a design is often technically complicated since a high number of additional components is required.

BRIEF SUMMARY OF THE INVENTION

It is therefore the object of the invention to propose a pen for writing and/or drawing purposes in which the core is adjustable in a simple and reliable manner.

The object is achieved by a pen for writing and/or drawing purposes having the features as claimed in the independent claim 1. The pen comprises a shaft and a core which is arranged within the shaft and is axially adjustable in the longitudinal direction of the shaft between an active position and an inoperative position. In the inoperative position, the core is arranged completely within the shaft and, in the active position, the core protrudes with an overhang from a front end of the shaft. The pen further comprises an actuating element which is movable perpendicularly to the longitudinal direction of the shaft between an active position and an inoperative position and which is operatively connected to the core via a connecting element in such a way that, during a movement of the actuating element perpendicularly to the longitudinal direction of the shaft between the inoperative position and the active position, the core is axially adjustable in the longitudinal direction of the shaft.

In other words: the actuating element is—with respect to a horizontally held pen—movable vertically upward and downward, that is to say in the radial direction with respect to a central longitudinal axis of the pen, with the core being movable horizontally forward and backward. The movement of the actuating element and the movement of the core thus occur in directions which extend perpendicularly to one another. The actuating element and the core are thus coupled in movement via the connecting element, with the result that, during an actuation of the actuating element, the core is displaced or adjusted axially, that is to say along or parallel to a central longitudinal axis of the shaft. Here, the actuating element is arranged in a rear portion or end of the shaft, and therefore it is operatively connected to a rear end of the core and displaces said core toward a front end of the shaft for movement into the active position.

The term "active position" is to be understood here as meaning that position of the core or of the actuating element when the pen is being used, that is to say is in the writing position or in a use state, i.e. the core is extended. In the inoperative position of the core or of the actuating element, the pen is situated in the nonuse state, i.e. the core is retracted.

The idea of the present invention thus consists in providing a mechanical pen in which the core is movable from its inoperative position into the active position reliably and repeatedly and in a manner which is simple for a user. In other words: during its actuation, a movement of the actuating element that has occurred perpendicularly to the longitudinal direction is converted into a movement of the core that occurs in the longitudinal direction. The connecting element affords the advantage that the path of the actuating element which the latter covers during a movement from the inoperative position into the active position can be shorter than the movement path of the core in the longitudinal direction that is required to reach the active position of the core. In addition, the movement of the actuating element perpendicularly to the longitudinal direction, by comparison with known pens in which the actuating element is moved just like the core in the longitudinal direction, means that less space is required within the shaft, with the result that the latter can be more compact overall, that is to say for example shorter or, for the same size, a longer core can be used in order to form a longer-life pen.

The connecting element is preferably rotatably mounted on the shaft in a central portion, a first end portion of the connecting element is preferably mounted on the actuating element, and a second end portion of the connecting element is preferably mounted directly or indirectly on the core. The connecting element is thus fastened to the shaft in a positionally fixed manner so as to be rotatable about an axis of rotation extending both perpendicularly to the longitudinal direction of the shaft and perpendicularly to the movement direction of the actuating element, in other words about an axis of rotation extending in the transverse direction. A central portion of the connecting element thus forms a rotation point or fixed point about which the connecting element or both the first and the second end portion of the connecting element can be rotated, with the position of this fixed point with respect to the shaft thus not changing relative to the shaft, that is to say no movement in the longitudinal direction taking place with respect to the shaft. The first and the second end portion of the connecting element are also fastened to the actuating element or to the core in a positionally fixed manner, with the result that the relative position of the first end portion with respect to the actuating element and the relative position of the second end portion with respect to the core likewise do not change during a movement from the inoperative position into the active position, and vice versa. If the actuating element is moved perpendicularly to the longitudinal direction of the shaft, a force is thus exerted on the first end portion of the connecting element. As a result, the first end portion of the connecting element is also moved perpendicularly to the longitudinal direction of the shaft, that is to say carried along by the actuating element, with the result that this brings about a rotation of the connecting element about the fixed point and thus also a movement of the second end portion and the core is moved from the inoperative position into the active position. In other words: the movement of the actuating element perpendicularly to the longitudinal direction of the shaft is converted by the connecting element into a movement of the core in the longitudinal direction of the shaft. The connecting element thus has the function of a lever.

The connecting element is preferably a single connecting element or a connecting element of one-part design which thus comprises only one connecting member which is rotatably mounted on the shaft in a central portion, is mounted on the actuating element by a first end portion, and is mounted on the core directly or indirectly by a second end portion of the connecting element. In order to make possible a reliable rectilinear adjustment of the core, in a further preferred embodiment the connecting element comprises at least two connecting members, that is to say in particular a first connecting member and a second connecting member, which are each connected to one another in an articulated manner. In each case adjacent connecting members are thus each connected to one another so as to be pivotable about a pivot axis in their mutually facing end portions. The pivot axes about which in each case two connecting members, for example the first and the second connecting member, are arranged pivotably with respect to one another likewise extend perpendicularly to the longitudinal direction of the shaft and also perpendicularly to the movement direction of the actuating element. In addition, the pivot axes are displaceable translationally in the longitudinal direction and perpendicularly to the longitudinal direction, with the movement occurring along a curved line which follows the rotation about the axis of rotation of the central portion of one of the connecting members that is fixed on the shaft. Here, a first connecting member which is connected to the actuating element is fixed on the shaft so as to be rotatable about the axis of rotation in a positionally fixed manner. The first end portion of the connecting element that is arranged on the actuating element is thus formed by the first connecting member, and the second end portion which is fixed on the core is formed by the second or, depending on the design form, a third or further connecting member. A plurality of connecting members have the advantage that, with the movement path of the actuating element perpendicularly to the longitudinal direction of the shaft remaining the same, a longer movement path of the core in the longitudinal direction can be achieved.

It would be conceivable for example to arrange a third or further connecting member in the form of a link chain between the actuating element and the core, with in each case adjacent connecting members being connected to one another in an articulated manner, that is to say pivotably about a pivot axis.

Preferably, in the inoperative position, the actuating element protrudes at least partially from a first lateral surface of the shaft and, in the active position, protrudes at least partially from a second lateral surface of the shaft that is opposite to the first. In the inoperative position, the actuating element in particular terminates level with the second lateral surface of the shaft and, in the active position, the actuating element in particular terminates level with the first lateral surface of the shaft. As a result, a disturbing overhang of the actuating element is largely avoided. In order to axially adjust the core, the respectively protruding part of the actuating element can be reached, with the result that the actuating element can be moved by pressing the respectively protruding portion from the active position into the inoperative position, and vice versa.

In a further preferred embodiment, the actuating element has a first longitudinal portion which extends in the longitudinal direction of the shaft and a second longitudinal portion which extends perpendicularly to the longitudinal direction and which is arranged at least partially within the shaft, wherein, in the inoperative position, at least the first longitudinal portion protrudes from the first lateral surface of the shaft and, in the active position, the second longitudinal portion protrudes by way of a free end at least partially from the second lateral surface of the shaft that is opposite to the first. In this case, the first longitudinal portion forms a retaining clip, for example, in order to make it possible to store the pen in the nonuse state in a pen compartment of a briefcase or in a breast pocket, for example. For this purpose, retaining or clamping means for captively inserting the pen can be integrally formed on the free end of the first longitudinal portion. By virtue of the fact that the first longitudinal portion protrudes from the lateral surface of the shaft only when the core is situated in the inoperative position, soiling, for example of the breast pocket or briefcase, is reliably avoided. The second longitudinal portion is at least partially held or guided in a rear region of the shaft and interacts with an inner peripheral surface of the shaft, for example in the sense of a sliding pair.

In a further preferred embodiment, the free end of the second longitudinal portion has a smaller width than an adjoining central portion of the second longitudinal portion, wherein the free end is at least partially arranged within a clearance of the shaft in the inoperative position and/or in the active position. Here, the clearance is formed in a portion of the shaft that adjoins the second lateral surface. Particularly both during the movement of the actuating element perpendicularly to the longitudinal direction of the shaft and in the inoperative position and in the active position, the second longitudinal portion or its free end thus prevents a movement of the actuating element in the longitudinal direction of the shaft, since said second longitudinal portion or its free end is held in the clearance with the formation of a form fit acting in the longitudinal direction.

Furthermore, the actuating element preferably has at least one stop surface which interacts with an inner peripheral surface of the shaft in the active position and/or inoperative position. This stop surface is arranged for example on the free end of the longitudinal portion and interacts with an inner peripheral surface delimiting the clearance of the shaft in order to prevent the movement of the actuating element in the longitudinal direction. In addition, the central portion of the second longitudinal portion that adjoins the free end can form a stop surface which bears against an inner peripheral surface of the shaft in the active position. As a result, it is made clear to the user for example that the active position of the core as end position has been reached, and excessively strong pressing of the actuating element is avoided. A further stop surface is formed for example by a rear end side of the actuating element, i.e. the end side facing the rear end of the shaft, which bears against an inner peripheral surface of the rear end of the shaft and is pressed against it during the movement of the actuating element from the inoperative position into the active position in order for the force resulting from the movement of the actuating element to be completely converted into a rotation of the connecting element. Furthermore, this ensures that the core is held in the active position and an independent movement of the core back into the inoperative position is prevented.

In order to be able to fix the connecting element or its first end portion on the actuating element, in an advantageous embodiment the actuating element, in particular the second longitudinal portion of the actuating element, has a clearance in which the first end portion of the connecting element is directly or indirectly mounted. The clearance extends both perpendicularly to the longitudinal direction of the shaft and perpendicularly to the movement direction of the actuating element. If the connecting element comprises a plurality of connecting members, the first end portion of the first connecting member is mounted in the clearance. Here, the connecting element is fixed in the clearance in such a way that a movement in the longitudinal direction of the shaft is prevented, with the result that it is not possible for the connecting element to slide out. The clearance can be designed in the form of a hole, for example, with the result that the connecting element can be fixed within the clearance by means of a pin or bolt.

In an advantageous embodiment, starting from a front end side of the actuating element, in particular from a front end side of the second longitudinal portion of the actuating element, the clearance at least partially extends into the actuating element in the longitudinal direction of the shaft, wherein the first end portion of the connecting element is movably mounted in the clearance. Here, the term "front end side" is to be understood as meaning the end side of the actuating element that faces the core and the front end of the shaft, the clearance thus extending perpendicularly to the longitudinal direction of the shaft and perpendicularly to the movement direction of the actuating element, that is to say in the transverse direction and in the direction of a rear end of the shaft. As a result, the connecting element and the actuating element can be mounted in a simple manner in that, for example, a pin or bolt fixed on the connecting element is movably held in the clearance. During a movement of the actuating element, the first end portion of the connecting element is carried along by it, and thus likewise moves perpendicularly to the longitudinal direction.

The pen has in particular a locking and/or latching device by means of which the core can be axially fixed in the active position and/or in the inoperative position, with the result that said core reliably remains in the active position during the writing operation and reliably within the shaft in the inoperative position. For example, the locking and/or latching device comprises locking and/or latching elements arranged on the connecting element, such as, for example, latching lugs which engage in a clearance of the shaft, for example a correspondingly formed groove, in the active position and/or in the inoperative position, that is to say in a respective end position of the core and of the actuating element. A further possibility consists in the connecting element being rotated during an actuation of the actuating element to such an extent that a force exerted on the core by a resetting element which prestresses the core in the active position in the axial or longitudinal direction prevents a back-rotation of the connecting element. Such a locking and/or latching device is particularly appropriate if the connecting element comprises only one connecting member.

In a preferred embodiment, the locking and/or latching device is formed by a joint which connects a first and a second connecting member, which joint connects the first and the second connecting member so as to be pivotable about a pivot axis. Here, for locking, the joint can be moved beyond a dead center if the actuating element is moved from the inoperative position into the active position. In other words: a joint connecting the two connecting members is moved beyond a plane formed by the axis of rotation and the bearing position of the connecting element or of a second connecting element on the core. This results in a self-locking system which prevents an independent movement of the core from the active position into the inoperative position.

In order to support the movement of the core from the active position into the inoperative position after the use of the pen, the pen can comprise, as already mentioned, a resetting element, in particular a spring, which prestresses the core in the active position in the axial or longitudinal direction. As soon as the actuating element is moved from the active position into the inoperative position and the locking or latching position is released, the core is as it were automatically moved back from the active position into the inoperative position. For this purpose, the spring is arranged in a front region of the shaft and presses the core axially in the longitudinal direction toward a rear region of the shaft. The resetting element additionally ensures that the connecting element is held securely on the actuating element, in particular in the clearance.

In a further preferred embodiment, the pen comprises a guide element for guiding the core that is arranged within the shaft between the core and the connecting element and is axially adjustable in the longitudinal direction. The guide element has a receptacle for receiving a rear end of the core. Here, the connecting element or a connecting member or a second, front end portion of the connecting element or of the connecting member is mounted on the guide element and is thus indirectly operatively connected to the core. The guide element is also always pressed against the connecting element by the resetting element, with the result that a reliable retention of the connecting element in the guide element is ensured. Such core guidance has the advantage that tilting or migration of the core during the axial adjustment is prevented. In a structurally simple variant, the guide element has a sleeve-shaped receiving portion for receiving the core and an adjoining guide portion which interacts with an inner peripheral surface of the shaft and slides along it during the axial adjustment and on which the connecting element or the connecting member is mounted or fastened. Here, the outer peripheral surface of the guide element is formed in a corresponding manner to the inner peripheral surface of the shaft, thus having for example a square or triangular cross section.

In an advantageous embodiment, the pen comprises at least one guide means for guiding the connecting element or a connecting member, in particular a front, first end portion of the connecting element or of a connecting member, and/or for guiding the actuating element in the shaft during a movement of the actuating element and of the core. This reliably avoids a transverse movement or jamming of the connecting element and/or of the actuating element during the actuation.

For example, the pen comprises at least one first guide means for guiding the connecting element in the shaft during a movement of the actuating element, which guide means comprises a clearance which is formed in the shaft and in which the connecting element is directly or indirectly guided. In other words, the connecting element is at least partially guided or displaceably mounted within a clearance formed on the inner peripheral surface of the shaft. For example, the connecting element is displaceably guided in the axial direction by means of a pin in a clearance designed as a slot, with the result that tilting of the connecting element and migration of the core are avoided. As an alternative to this, the connecting element can be mounted only within the guide element, which is in turn supported by an outer peripheral surface on an inner side of the shaft or on the actuating element, to be more precise on its first longitudinal portion.

To guide the actuating element in the shaft during a movement, in a further preferred embodiment the pen has at least one second guide means for guiding the actuating element in the shaft during a movement of the actuating element, which guide means comprises at least one projection which protrudes from an inner peripheral surface of the shaft, extends perpendicularly to the longitudinal direction of the shaft and interacts in the sense of a sliding pair with at least one receptacle which is formed on a lateral surface of the actuating element, in particular on a lateral surface of the second longitudinal portion, and extends perpendicularly to the longitudinal direction. During an actuation of the actuating element perpendicularly to the longitudinal direction, the latter is thus guided within the shaft. A movement direction of the actuating element that is other than perpendicular to the longitudinal direction is not possible, with the result that jamming or tilting is reliably prevented.

The receptacle is preferably formed by a projection which protrudes from a lateral surface of the actuating element, in particular of the second longitudinal portion, and which extends perpendicularly to the longitudinal direction starting from the first longitudinal portion and at least partially along the lateral surface, and by an end portion of the actuating element, in particular of the second longitudinal portion, that projects with an overhang beyond the lateral surface. The rear end portion of the actuating element bears at least partially level against a rear inner peripheral surface of the shaft and thus prevents a movement of the actuating element in the direction of the rear end of the shaft.

BRIEF DESCRIPTION OF THE SEVERAL VIEWS OF THE DRAWING

The invention will be explained in more detail with reference to the exemplary embodiments illustrated in the appended drawings, in which.

DESCRIPTION OF THE INVENTION

Figure 1:
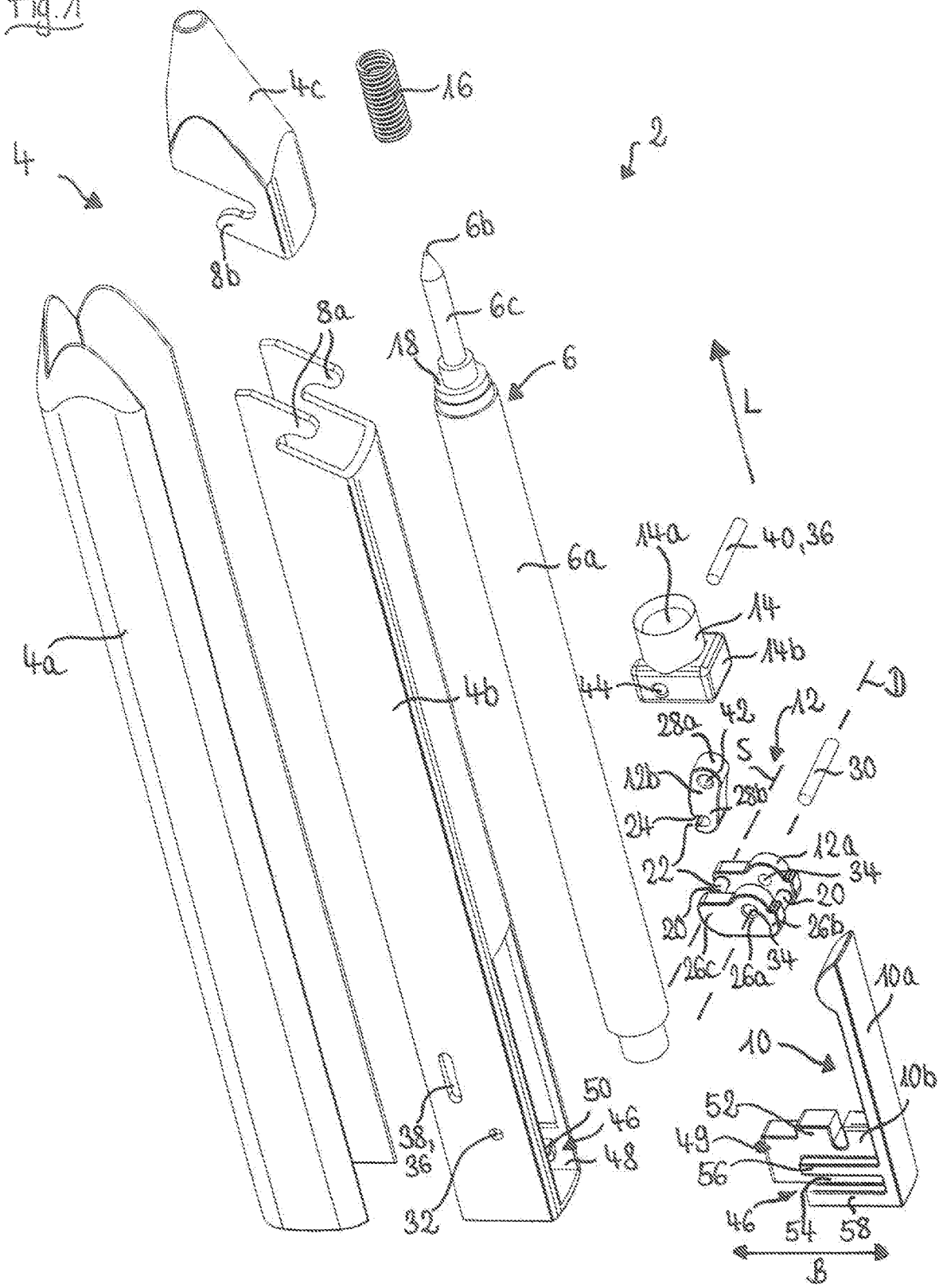
FIG. 1 shows an exploded illustration of a pen.

FIG. 1 shows an exploded illustration of a pen 2 for writing and/or drawing purposes, having a shaft 4 and having a core 6. The shaft 4 comprises a first elongate shaft part 4*a*, a second elongate shaft part 4*b* and a third conical shaft part 4*c*. The first shaft part 4*a* and the second shaft part 4*b* each at least substantially have a U-shaped cross-sectional profile, with the open sides of the shaft parts 4*a*, 4*b* facing one another in the mounted state. In the mounted state, the second shaft part 4*b* is arranged within the first shaft part 4*a* and is for example held clamped therein or additionally adhesively bonded or fixed by means of a tongue-groove connection. Integrally formed on a front end portion of the second shaft part 4*b* are retaining elements 8*a* which, in the mounted state, engage in a form-fitting manner in complementarily formed retaining elements 8*b* of a rear end portion of the third shaft part 4*c*. The first, outer shaft part 4*a* can be produced from wood, for example, in order to impart a good tactile and visual impression to the user. In principle, the shaft 4 can also be formed in one piece, but a multipart shaft 4 has the advantage that, on the one hand, the assembly of the pen 2 is facilitated and, on the other hand, the mechanical components necessary for actuating the core 6 are for the large part not visible to the outside.

The core 6, for example a ballpoint pen core in the present case, having a reservoir 6*a* for storing the ink paste and a writing tip 6*c* bearing a writing ball 6*b* is arranged within the shaft 4, to be more precise within its inner part, namely within the second shaft part 4*b*, and is axially adjustable in the longitudinal direction L of the shaft 4 between an active position and an inoperative position. In the inoperative position (FIGS. 2 to 8), the core 6 is arranged completely within the shaft. In the active position (FIGS. 9 to 14), the core 6 projects by way of its front end, that is to say a part of the writing tip 6*c* and of the writing ball 6*b*, with an overhang from a front end of the shaft 4 or of the shaft part 4*c*.

The pen 2 has, on a rear end, an actuating element 10 which is movable between an inoperative position and an active position in a movement direction B extending perpendicularly to the longitudinal direction L and which, for axial adjustment of the core 6, is operatively connected thereto via a connecting element 12, with the result that, during a movement of the actuating element perpendicularly to the longitudinal direction of the shaft between the inoperative position and the active position, the core is axially adjustable in the longitudinal direction of the shaft. The actuating element 10 has a first longitudinal portion 10*a* which extends in the longitudinal direction L of the shaft 4 and an adjoining base body or second longitudinal portion 10*b* which extends perpendicularly to the longitudinal direction L starting from the first longitudinal portion 10*a*.

A guide element 14 for guiding the core 6 is arranged within the shaft 4 between the core 6 and the connecting element 12 and is axially adjustable in the longitudinal direction L, with the result that the connecting element 12 is indirectly connected to the core 6 via the guide element 14. Here, in the mounted state, the connecting element 12 can be fastened to the guide element 14. The guide element 14 has a receptacle 14*a* for receiving a rear end of the core 6. A part of an outer peripheral surface 14*b* of the guide element 14 is formed in a complementary manner to an inner peripheral surface of the shaft 4 or of the shaft part 4*b* in order to allow problem-free sliding.

The pen 2 has, on a front end, a resetting element, in the present case a spring 16, which surrounds the writing tip 6*c* in the mounted state and prestresses the core 6 in the active position in a longitudinal direction L of the shaft 4. In the mounted state, the spring 16 is supported by a first end 16*a* on a front end side 18 of the core 6 or of the reservoir 6*a* and by a second end 16*b* on an inner peripheral surface of the conical shaft part 4*c*, in particular on a stop surface formed on the inner peripheral surface. In the active position, the spring 16 is prestressed, that is to say compressed, and, in the inoperative position, the spring 16 is relaxed. The spring 16 always presses the guide element 14 in the direction of the rear end of the pen 2 and thus against the connecting element 12, with the result that a fastening of the connecting element 12 in or on the guide element 14 is not absolutely necessary.

According to the exemplary embodiment, the connecting element 12 comprises a first connecting member 12*a* and a second connecting member 12*b* which are connected to one another so as to be pivotable about a pivot axis S. The first connecting member 12*a* comprises two plate-shaped elements which are arranged parallel to one another and which are connected at two opposite end portions via a respective web 20. In the exemplary embodiment, the joint 22 connecting the first connecting member 12*a* to the second connecting member 12*b* is formed by one of these webs 20 and a clearance 24 in the second connecting member 12*b*.

The connecting element 12, the first connecting member 12*a* according to the exemplary embodiment, is rotatably mounted in a central portion 26*a* about an axis of rotation D on the shaft 4, to be more precise on the inner part of the shaft 4, namely the shaft part 4*b*. For this purpose, the plate-shaped elements of the first connecting member 12*a* each have a through-hole 34 through which there is plugged a connecting element 30, in the present case a cylindrical pin, which is in turn is mounted in a clearance 32 of the shaft 4 or of the second shaft part 4*b*. A first end portion 26*b* of the connecting element 12 or of the first connecting member 12*a* is fastened to the actuating element 10, namely to its second longitudinal portion 10*b*, and a second end portion 28*a* of the connecting element 12 or of the second connecting member 12*b* is fastened to the guide element 14, that is to say indirectly mounted on the core 6. The mutually facing end portions 26*c*, 28*b* of the first connecting member 12*a* and of the second connecting member 12*b* are pivotably connected via the joint 22.

The pen 2 has guide means 36 for guiding the connecting element 12 in the shaft 4 or the second shaft part 4*b* during a movement of the actuating element 10 and of the core 6. According to the present exemplary embodiment, the guide means 36 comprises a clearance 38 which is formed in the shaft 4 or the second shaft part 4*b* and in which the connecting element 12 is indirectly guided. Furthermore, the guide means 36 comprises a connecting element 40, for example likewise a cylindrical pin, which is plugged through a through-hole 42 incorporated in the second connecting member 12*b* and through a through-hole 44 incorporated in the guide element 14. The connecting element 40 is mounted in the clearance 38, which is designed as a slot in the present case, in order to guide the connecting element 12 or the second connecting member 12*b* during a movement of the core 6 from the inoperative position into the active position, and vice versa.

The pen 2 has guide means 46 for guiding the actuating element 10 in the shaft 4 or the second shaft part 4*b* during a movement of the actuating element 10 and of the core 6. The guide means 46 comprises a projection 50 which projects from an inner peripheral surface 48 of the shaft 4 or of the second shaft part 4*b* and which extends perpendicularly to the longitudinal direction L of the shaft 4. Furthermore, the guide means 46 comprises a receptacle 54 which is formed on a lateral surface 52 of the actuating element 10 or its second longitudinal portion 10*b* and which extends perpendicularly to the longitudinal direction L and, in the mounted state, parallel to the projection 50. During a movement of the actuating element in the movement direction B, the receptacle 54 and the projection 50 interact in the sense of a sliding pair.

Here, the receptacle 54 is formed by a projection 56 which protrudes from the lateral surface 52 of the actuating element 10 or its second longitudinal portion 10*b*, is perpendicular to the longitudinal direction L starting from the first longitudinal portion 10*a* and extends up to a free end 49 of the second longitudinal portion 10*b*, and by an end portion 58 of the actuating element 10 or its second longitudinal portion 10*b* that projects with an overhang beyond the lateral surface 52 in the direction of a rear end of the shaft.

Figure 2:
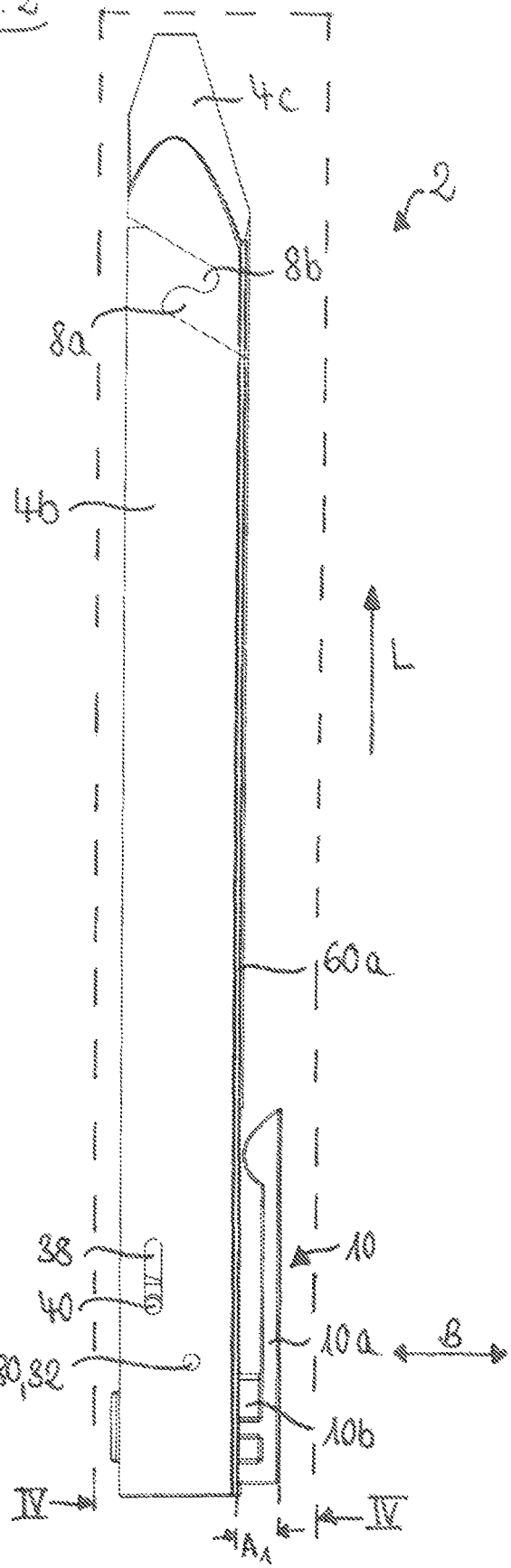
FIG. 2 shows a side view of a pen in the inoperative position.
Figure 7:
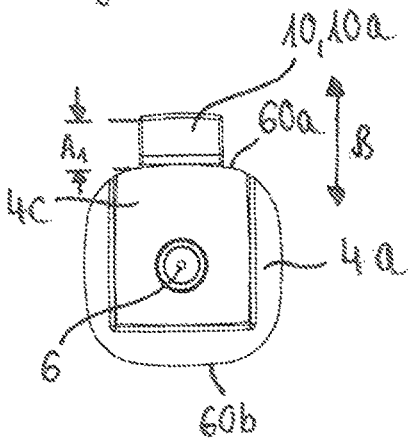
FIG. 7 shows a front view of the pen according to FIG. 2.
Figure 3:
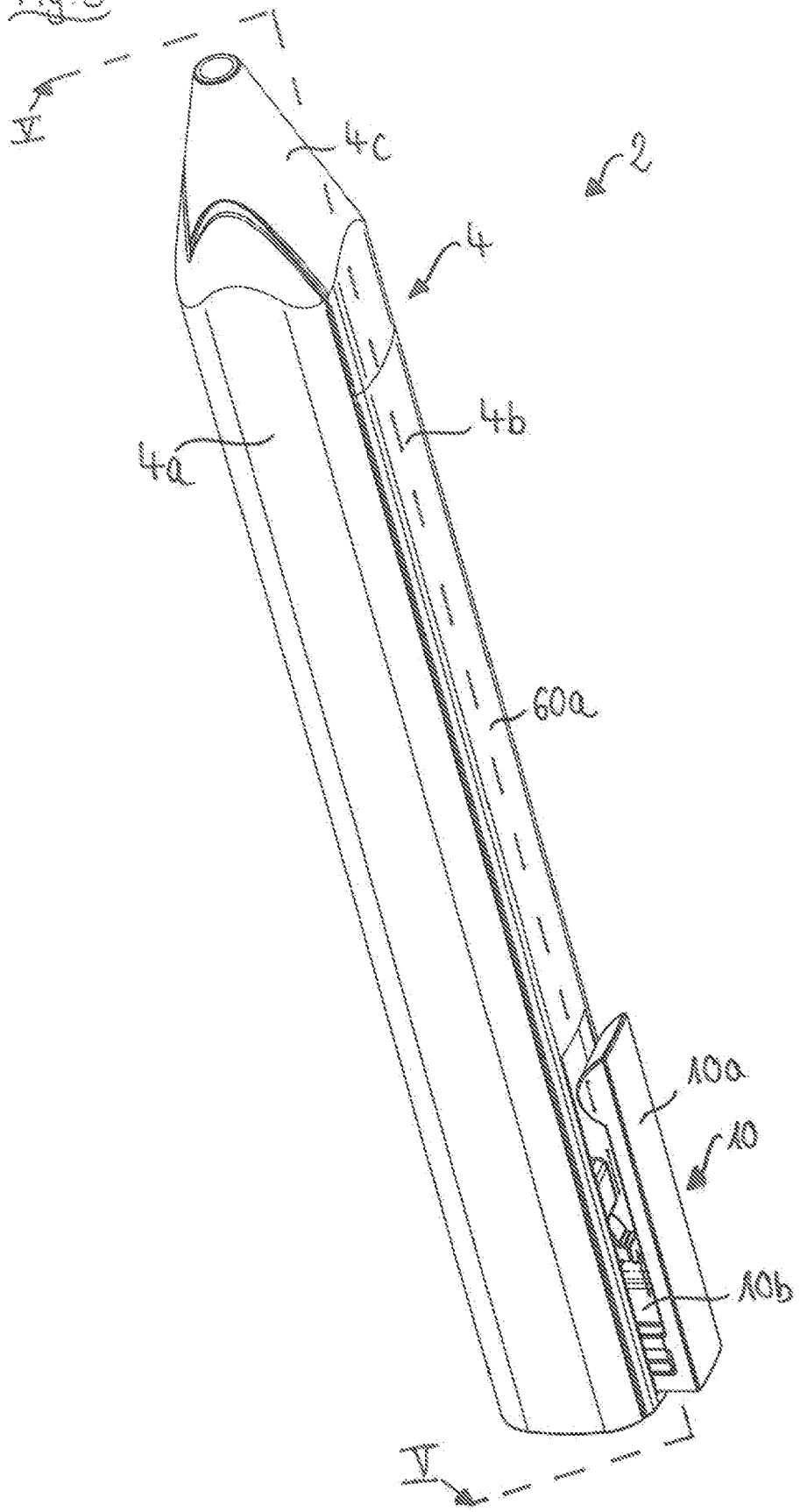
FIG. 3 shows a perspective illustration of the pen according to FIG. 2.

FIGS. 2 to 8 show the pen 2 in various views while it is situated in the nonuse state, both the core 6 and the actuating element 10 thus being in the inoperative position. The core 6 is arranged completely within the shaft 4 in the inoperative position. In the inoperative position, the actuating element 10 protrudes partially, namely by way of its first longitudinal portion 10*a* and a part of the second longitudinal portion 10*b*, with an overhang $A_1$ from a first lateral surface 60*a* of the shaft 4 or from an upper side of the shaft 4. According to FIG. 2, in which the pen 2 is shown without the outer, first shaft part 4*a* in order to better illustrate the guide means 36, the connecting element 40 is arranged in the inoperative position at a rear end of the clearance 38. FIG. 3 shows a pen 2 with an outer first shaft part 4*a* which conceals the guide means 36 and consists of wood or plastic, for example.

Figure 4:
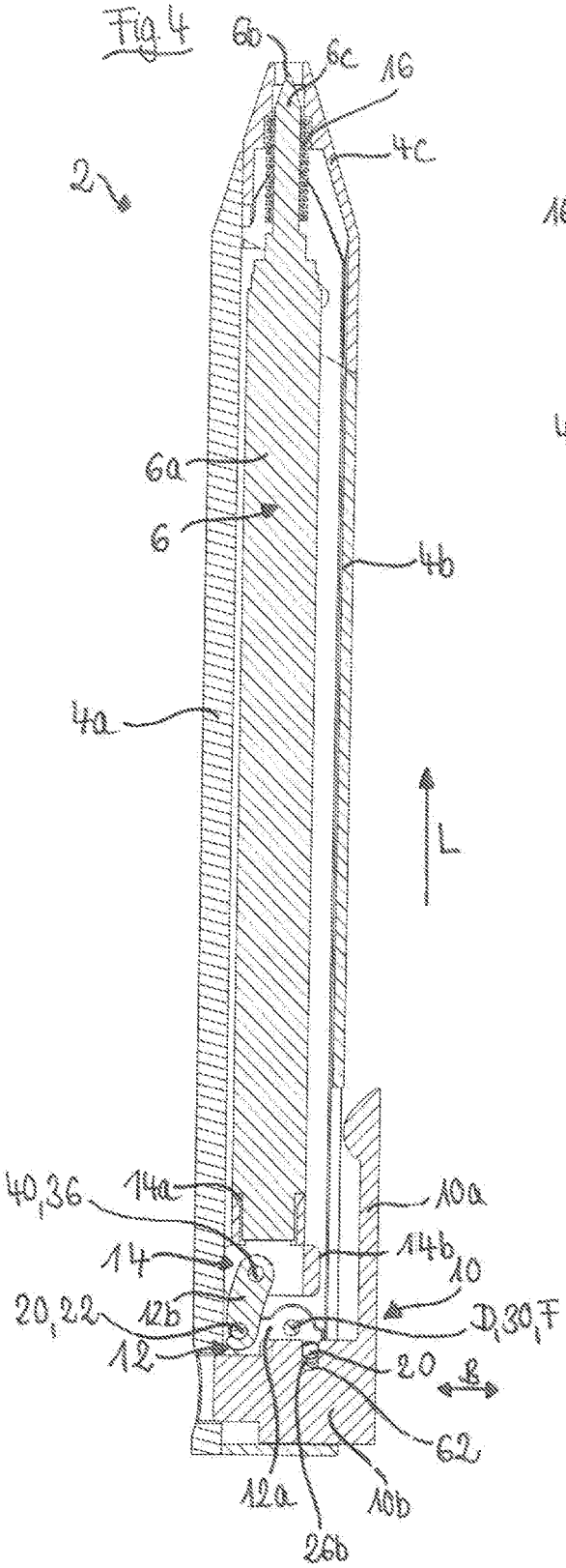
FIG. 4 shows a longitudinal section taken along the line IV-IV in FIG. 2.
Figure 5:
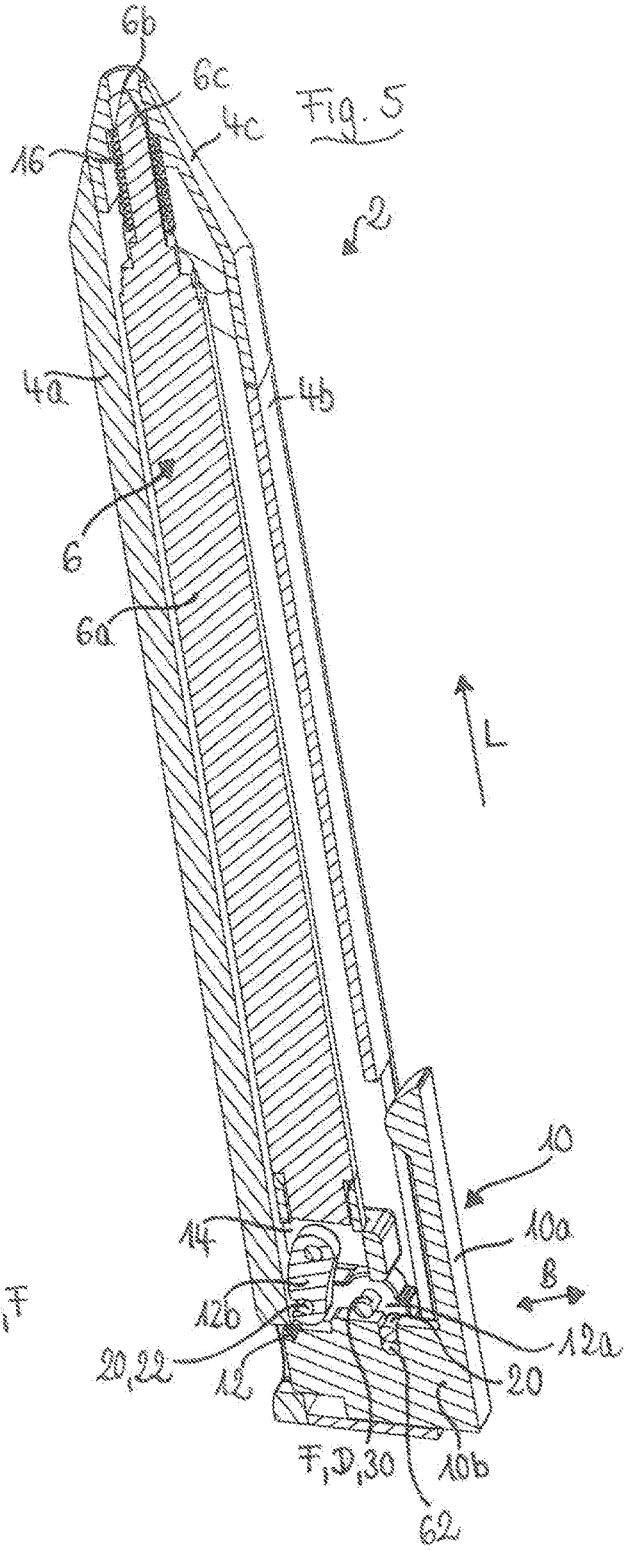
FIG. 5 shows a longitudinal section taken along the line V-V in FIG. 3 in a perspective illustration.
Figure 6:
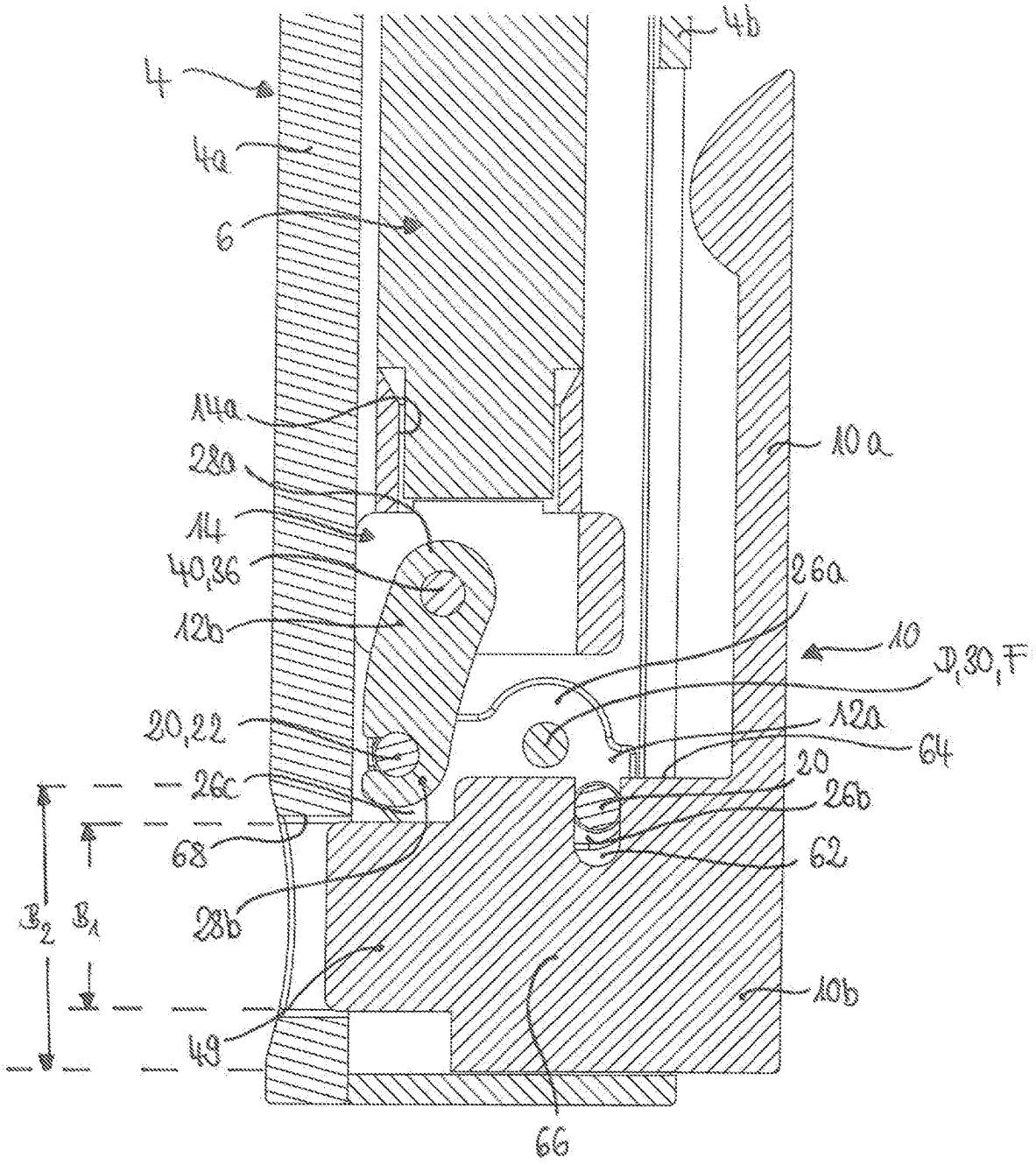
FIG. 6 shows a partial detail of the pen according to FIG. 4.
Figure 8:
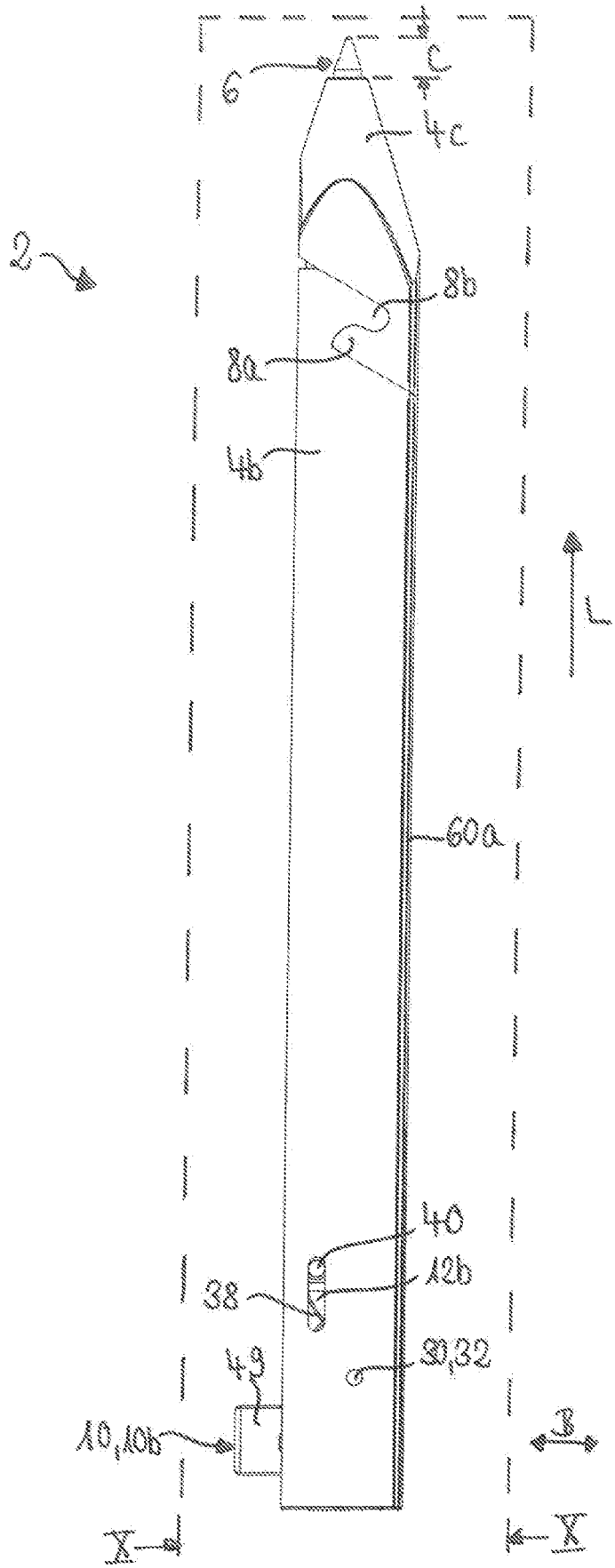
FIG. 8 shows a side view of a pen in the active position.
Figure 9:
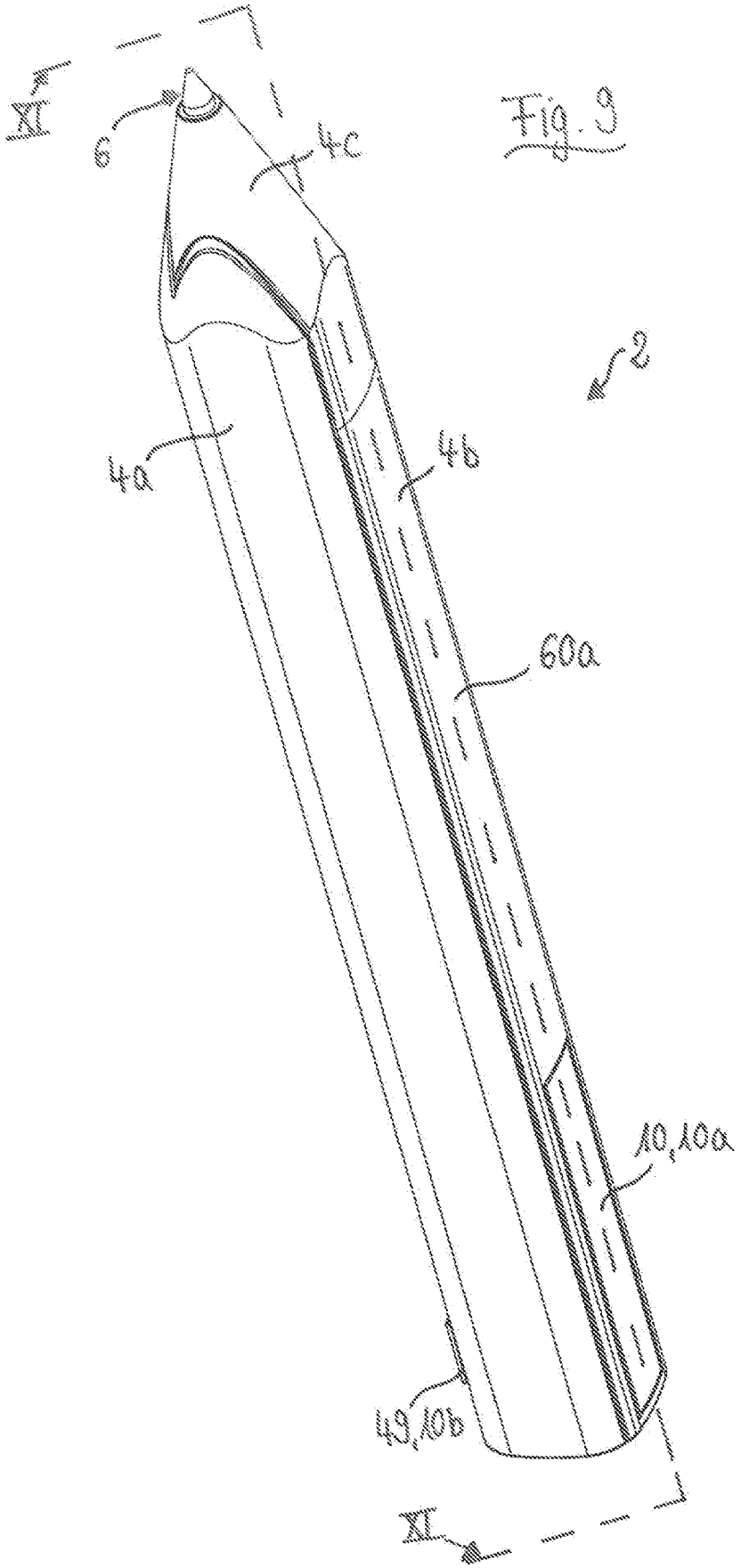
FIG. 9 shows a perspective illustration of the pen according to FIG. 8.
Figure 10:
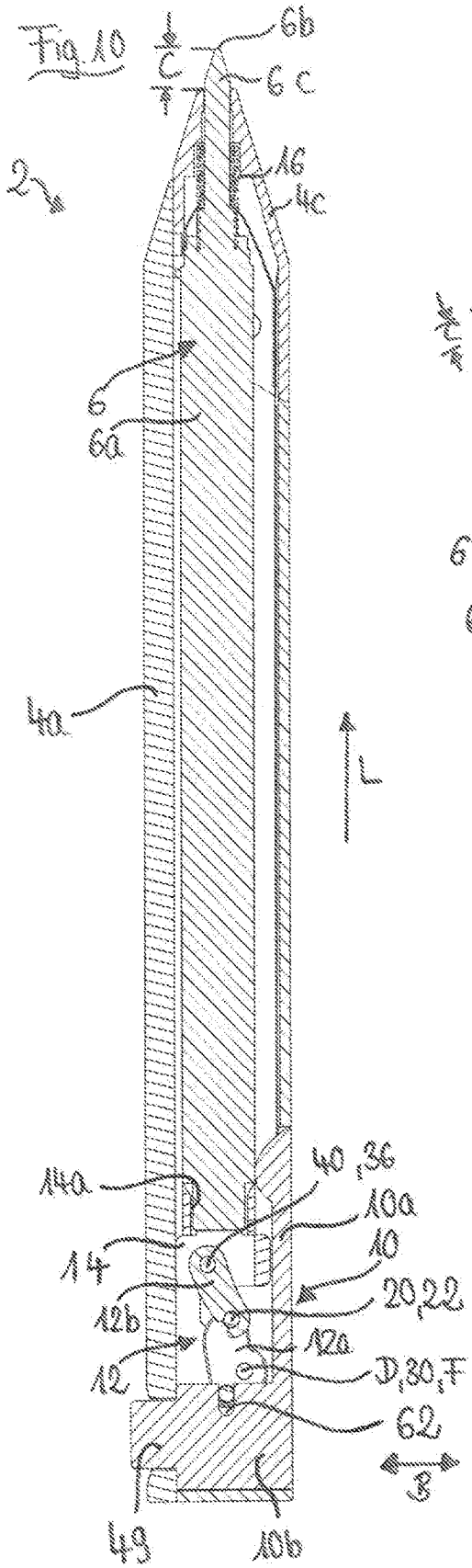
FIG. 10 shows a longitudinal section taken along the line X-X in FIG. 8.
Figure 11:
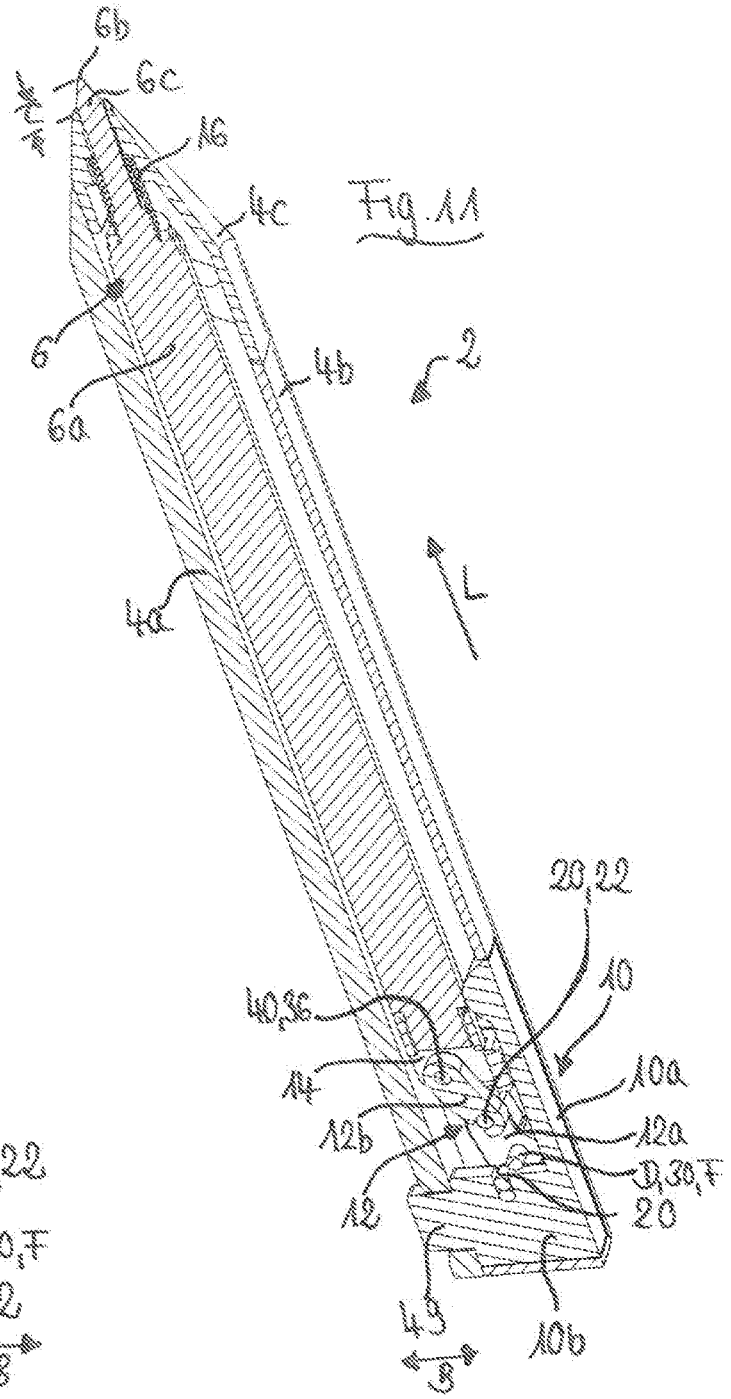
FIG. 11 shows a longitudinal section taken along the line XI-XI in FIG. 8 in a perspective illustration.

FIGS. 4 and 5 respectively show a longitudinal section taken along the line IV-IV in FIG. 2 and along the line V-V in FIG. 3, and FIG. 6 shows a detail view of a rear portion of the pen 2. Both the actuating element 10 and the core 6 and also the connecting element 12 are situated in the inoperative position. In the inoperative position, the first connecting member 12*a* of the connecting element 12 is arranged virtually parallel to the actuating element 10. A first end portion 26*b* of the first connecting member 12*a* is mounted in a clearance 62 of the actuating element 10 or of the second longitudinal portion 10*b* of the actuating element 10. Starting from a front end side 64 of the actuating element 10 or of the second longitudinal portion 10*b* of the actuating element 10, the clearance 62 partially extends into the actuating element 10 in the longitudinal direction of the shaft. The connecting element 12 or the first connecting member 12*a* is movably mounted in the clearance 62 by means of the cylindrical web 20 arranged in the clearance 62. If the actuating element 10 is moved perpendicularly to the longitudinal direction L of the shaft in the movement direction B, the first end portion 26*b* of the connecting element 12 or of the first connecting member 12*a* is carried along by the actuating element 10 and thus likewise moved perpendicularly to the longitudinal direction L of the shaft. This brings about a rotation of the connecting element 12 or of the first connecting member 12*a* about the axis of rotation D or about the fixed point F at which the connecting element is mounted in a positionally fixed but rotatable manner on the shaft 4. The second end portion of the first connecting member 12*a* is consequently moved both in the longitudinal direction L of the shaft 4 and upward, that is to say perpendicularly to the longitudinal direction L of the shaft 4, and consequently pushes the second connecting member 12*b*, which is connected thereto via the joint 22, and hence the core 6 in the longitudinal direction L of the shaft into the active position.

The free end 49 of the second longitudinal portion 10*b* of the actuating element 10 has a smaller width $B_1$ than a width $B_2$ of an adjoining central portion 66 of the second longitudinal portion 10*b*. The free end 49 is also partially arranged in a clearance 68 of the shaft 4 in the inoperative position in order to avoid jamming or blocking of the actuating element 10 at the start of the movement.

In the active position, the core can be fixed by a locking device which is here realized by the joint 22 connecting the first and the second connecting member 12*a*, 12*b* of the connecting element 12. By rotating the first connecting member 12*a* about the rotation point, the joint 22 is moved beyond the dead center and an uncontrolled backward movement of the core 6 from the active position into the inoperative position during the writing operation is thus prevented.

FIGS. 8 to 13 show the pen 2 in various views while it is situated in the use state or in the writing position, both the core 6 and the actuating element 10 thus being in the active position. In the active position, the second longitudinal portion 10*b* of the actuating element 10 protrudes partially, specifically by way of a free end 49, with an overhang $A_2$ from a second lateral surface 60*b* of the shaft 4 that is situated opposite to the first lateral surface 60*a* of the shaft. The core 6 protrudes with an overhang C from the front end of the shaft 4.

The free end 49 of the second longitudinal portion 10*b* of the actuating element 10 has a smaller width $B_1$ than an adjoining central portion 66 of the second longitudinal portion 10*b*. The free end 49 is arranged completely in a clearance 68 of the shaft 4 and additionally protrudes beyond the second lateral surface 60*b*. In order to move the core 6 from the active position back into the inoperative position again, the locking device can be released by pressing on the free end 49 of the actuating element and the core 6 is moved back into the inoperative position by rotation of the connecting element 12 or of the connecting member 12*a* by means of the spring 16 which is prestressed in the active position.

Figure 12:
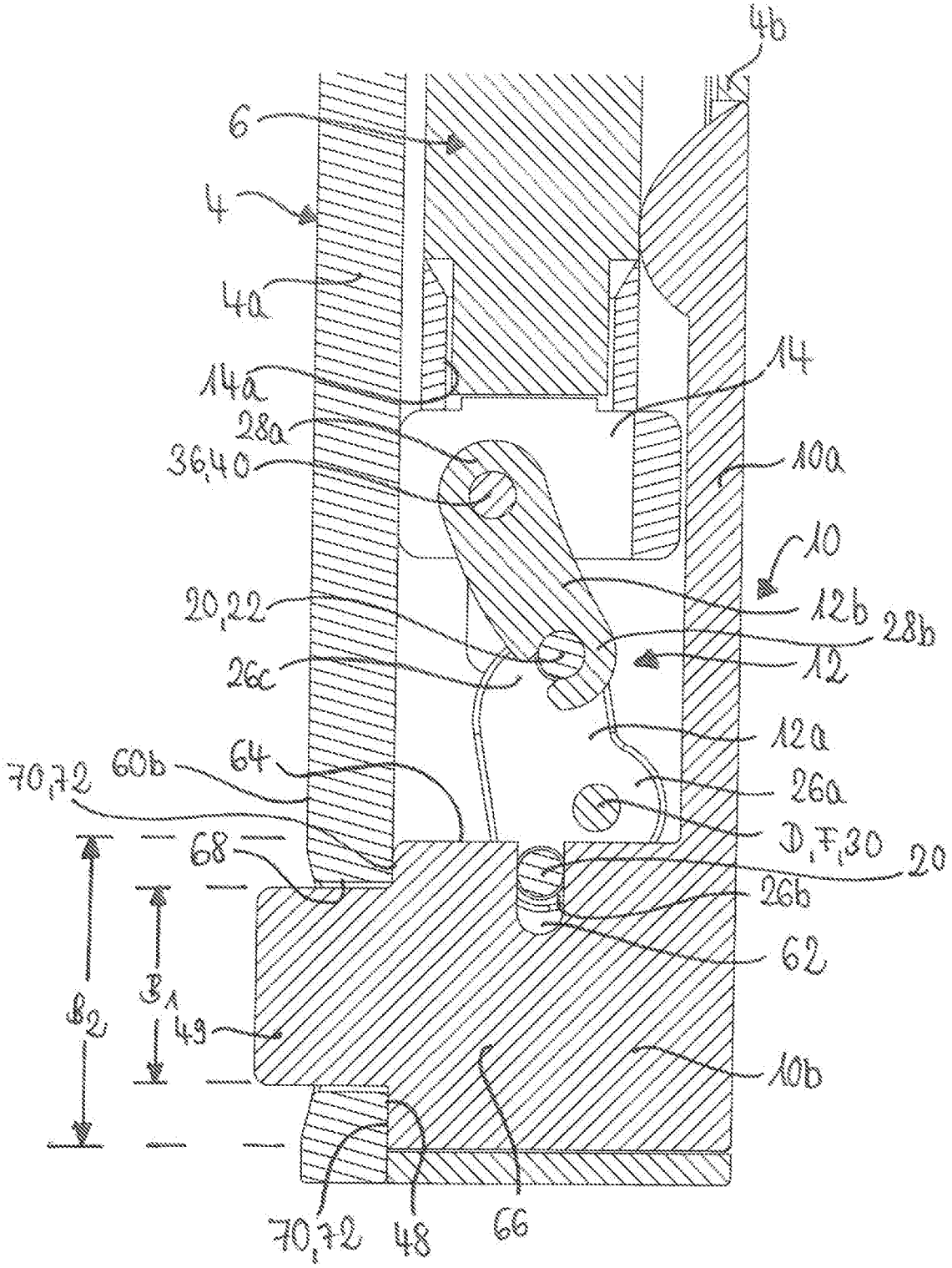
FIG. 12 shows a partial detail of the pen according to FIG. 10.
Figure 14:
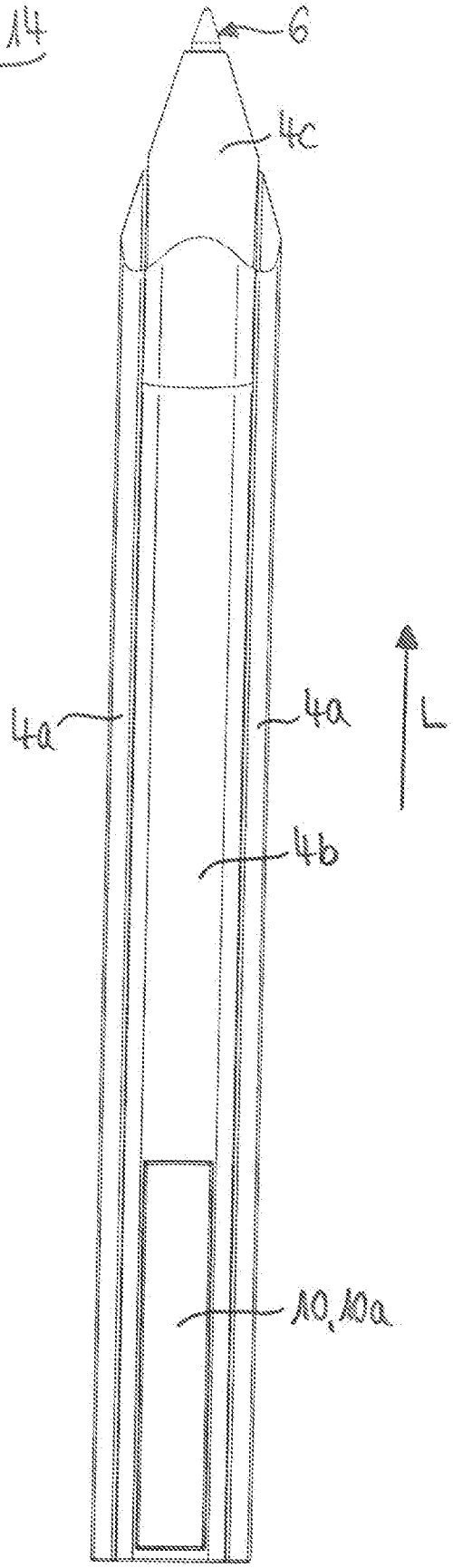
FIG. 14 shows a plan view of a pen according to FIG. 8.
Figure 13:
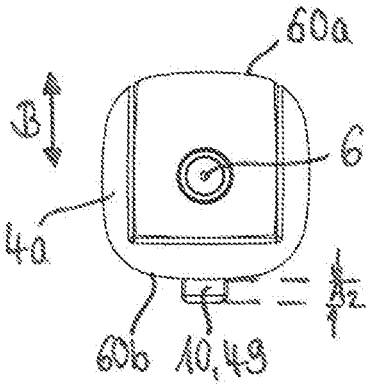
FIG. 13 shows a front view of the pen according to FIG. 8.

As can be seen in particular in the detail view in FIG. 12, the actuating element 10 has a stop surface 70 which bears against the inner peripheral surface 48 of the shaft 4 in the active position and prevents a further movement of the actuating element 10 and also signals to the user that the end position has been reached. The stop surface 70 is formed by a lower lateral surface 72 of the central portion 66 of the second longitudinal portion 10*b* of the actuating element 10.

Figure 15:
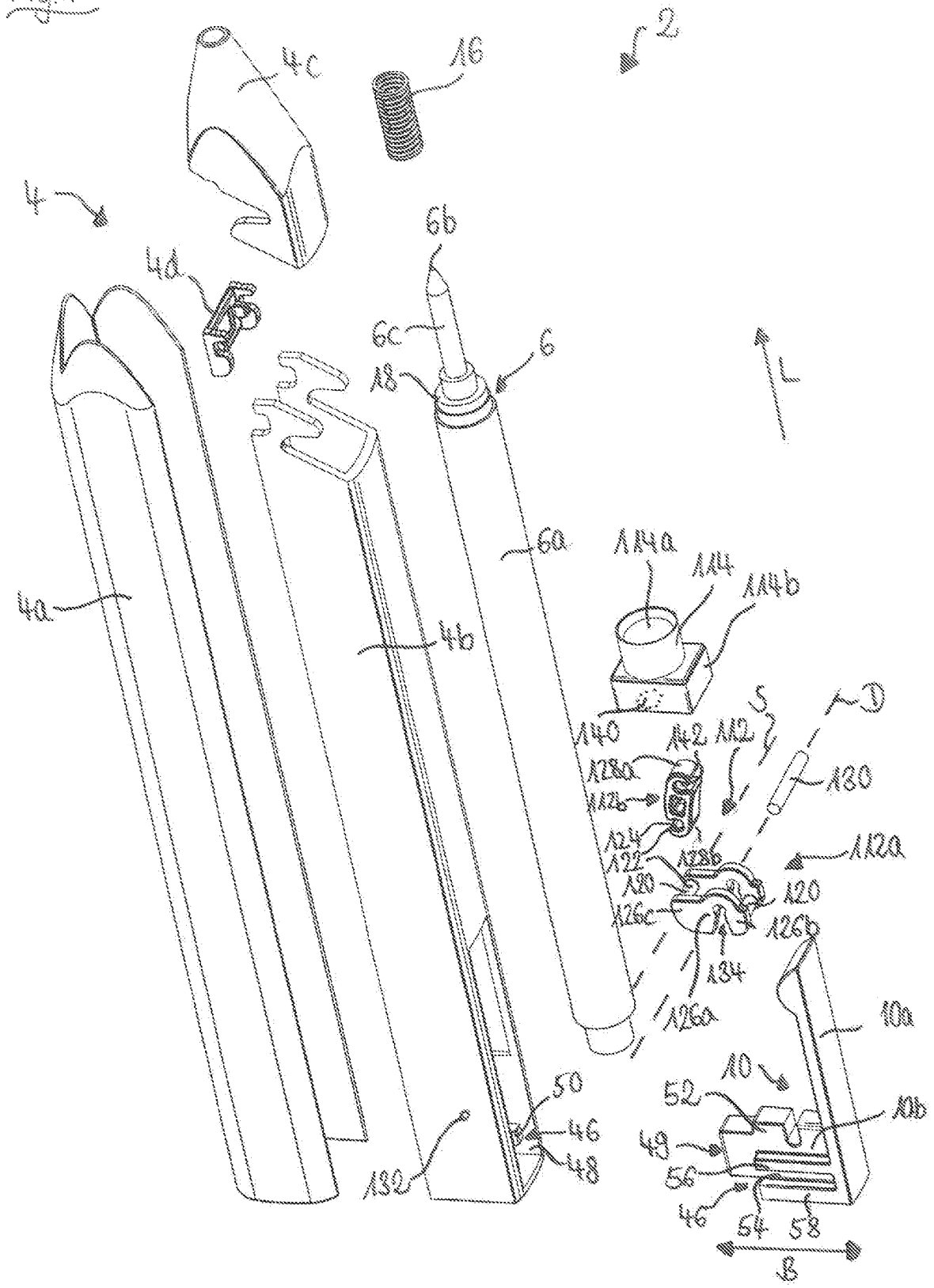
FIG. 15 shows an exploded illustration of a pen according to a further embodiment.

FIG. 15 shows an exploded illustration of a further embodiment of the pen 2 for writing and/or drawing purposes which substantially has the features according to the above-described pen 2, and therefore reference is predominantly made thereto. Corresponding features are labeled with identical reference signs. The pen 2 comprises a shaft 4 having a first elongate shaft part 4*a*, a second elongate shaft part 4*b*, a third conical shaft part 4*c* and a fourth shaft part 4*d* which in the present case serves in particular to connect the second shaft part 4*b* to the third shaft part 4*c*. The core 6, once again for example a ballpoint pen core, having a reservoir 6*a* for storing the ink paste and a writing tip 6*c* bearing a writing ball 6*b* is arranged within the shaft 4, to be more precise within its inner part, namely within the second shaft part 4*b*, and is axially adjustable in the longitudinal direction L of the shaft 4 between an active position and an inoperative position. In the inoperative position, the core 6 is arranged completely within the shaft and, in the active position, the core 6 protrudes by way of its front end with an overhang from a front end of the shaft 4 or of the shaft part 4*c*. A resetting element or a spring 16 once again prestresses the core 6 in the active position in a longitudinal direction L of the shaft 4.

The pen 2 once again has, on a rear end, an actuating element 10 which can be moved between an inoperative position and an active position in a movement direction B extending perpendicularly to the longitudinal direction L, said actuating element having a first longitudinal portion 10*a* and a second longitudinal portion 10*b* and, for axial adjustment of the core 6, being operatively connected thereto via a connecting element 12, with the result that, during a movement of the actuating element 10 perpendicularly to the longitudinal direction of the shaft between the inoperative position and the active position, the core is axially adjustable in the longitudinal direction of the shaft.

The difference over the pen described in FIGS. 1 to 14 now consists in the design of the guide element 14 or 114 and of the connecting element 12 or 112. The guide element 114 is arranged within the shaft 4 between the core 6 and the connecting element 112 and is axially adjustable in the longitudinal direction L, with the result that the connecting element 112 is indirectly connected to the core 6 via the guide element 114. The guide element 114 has a receptacle 114*a* for receiving a rear end of the core 6. A part of an outer peripheral surface 114*b* of the guide element 114 is formed in a complementary manner to an inner peripheral surface of the shaft 4 or of the shaft part 4*b* to allow problem-free sliding.

The connecting element 112 comprises for example a first connecting member 112*a* and a second connecting member 112*b* which are connected to one another so as to be pivotable about a pivot axis S. The first connecting member 112*a* comprises two plate-shaped elements which are arranged parallel to one another and which are connected at two opposite end portions via a respective web 120. The joint 122 which connects the first connecting member 112*a* to the second connecting member 112*b* is once again formed by one of these webs 120 and a clearance 124 in the second connecting member 112*b*.

The connecting element 112, the first connecting member 112*a* according to the exemplary embodiment, is rotatably mounted in a central portion 126*a* about an axis of rotation D on the shaft 4, to be more precise on the inner part of the shaft 4, namely the shaft part 4*b*. For this purpose, the plate-shaped elements of the first connecting member 112*a* each have a clearance 134 through which there is plugged a connecting element 130, in the present case a cylindrical pin, which once again is mounted in a clearance 132 of the shaft 4 or of the second shaft part 4*b*. A first end portion 126*b* of the connecting element 112 or of the first connecting member 112*a* is fastened to the actuating element 10, namely to its second longitudinal portion 10*b*, and a second end portion 128*a* of the connecting element 12 or of the second connecting member 112*b* is fastened to the guide element 14, that is to say indirectly mounted on the core 6. The mutually facing end portions 126*c*, 128*b* of the first connecting member 112*a* and of the second connecting member 112*b* are pivotably connected via the joint 122.

To guide the connecting element 112, the pen 2 has guide means 136 according to an alternative variant. According to the present exemplary embodiment, the guide means 136 comprises a connecting element 140 (shown in dotted line), for example likewise a cylindrical pin, which is mounted within or fastened to the guide element 114. In this case, instead of the through-hole, a clearance 142 is provided on the second end portion 128*a* of the connecting element 112 or of the connecting member 112*b* and engages around the connecting element 140 fixed within the guide element 114 in such a way that the connecting element 112 is held within the guide element 114 during a movement in the axial direction.

Figure 16:
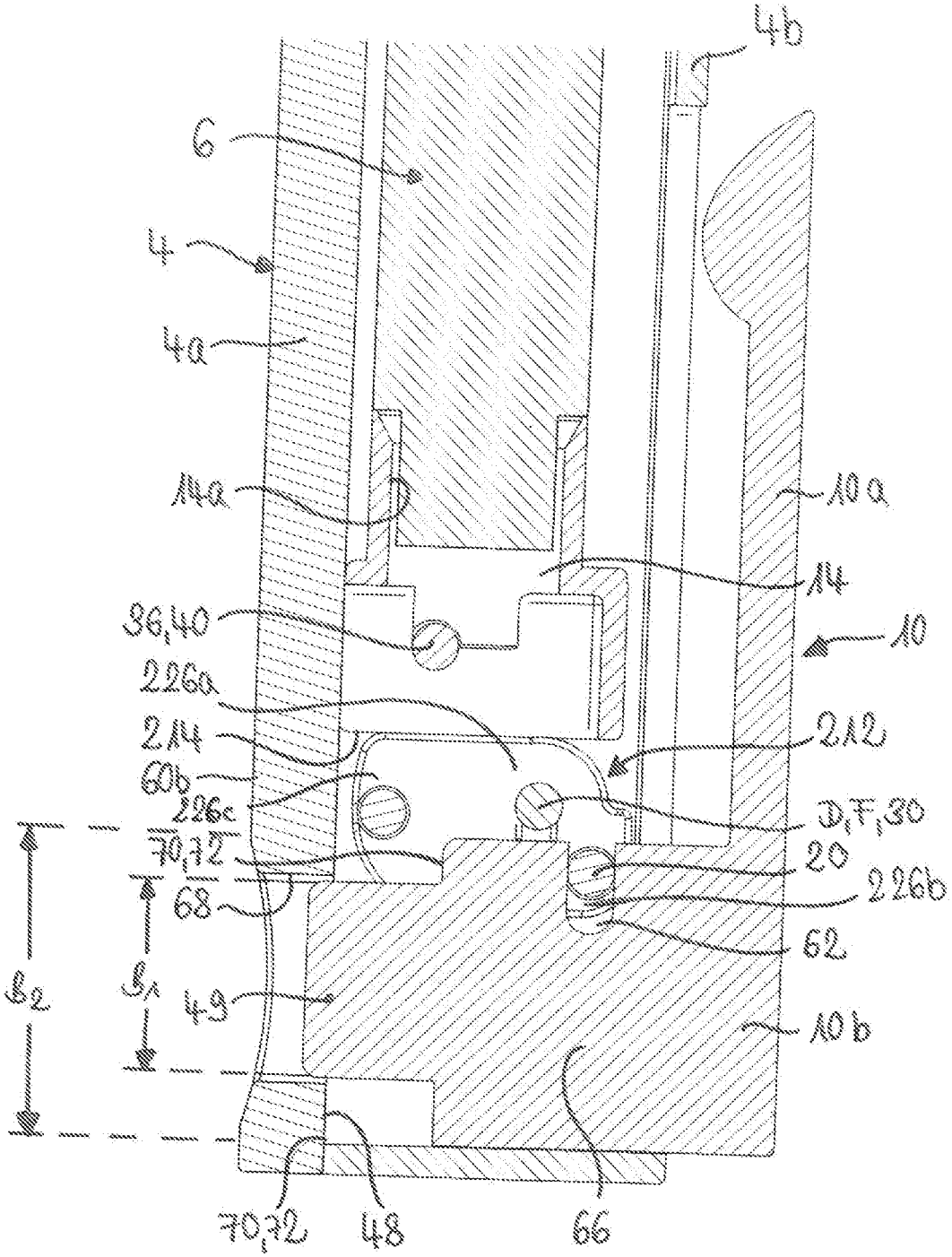
FIG. 16 shows a partial detail of a pen according to a further embodiment in the inoperative position.

FIGS. 16 (inoperative position) and 17 (active position) show a detail of a rear end portion of a pen 2 (not explicitly represented) in which the connecting element 212 comprises only a first, that is to say a single, connecting member, with the result that the connecting element 212 is of one-part design. If the core does not have to cover a large path, that is to say such a large step-up is not required, such a design offers the advantage that material can be saved.

The connecting element 212 is mounted on the shaft 4 so as to be rotatable about an axis of rotation D. The connecting element 212 is mounted by a first end portion 226*b* in a clearance 62 which extends into the actuating element 10 from a front end side 64 thereof. A front end portion 226*c* of the connecting element 212 is mounted on the guide element 14 and thus indirectly connected to the core 6. In the active position, the connecting element 212 extends substantially in the longitudinal direction L of the shaft 4, i.e. the front end portion 226*b* and the rear end portion 226*c* are arranged behind one another in the longitudinal direction. The connecting element 212 is rotated about the axis of rotation by the actuation of the actuating element 10 to such an extent that a resetting force of the resetting element that presses the guide element 14 against the front end portion 226*c* of the connecting element 212 is not sufficient to cause a back-rotation of the connecting element 212. As a result, the core 6 is locked in the active position. Only a movement of the actuating element from the active position into the inoperative position brings about a rotation of the connecting element 212 and thus a release of the locking. In the inoperative position, the connecting element 212 bears flat against a rear end side 214 of the guide element 14 and extends substantially transversely to the longitudinal direction L of the shaft 4, i.e. the front end portion 226*b* and the rear end portion 226*c* are arranged next to one another in the transverse direction.

Figure 17:
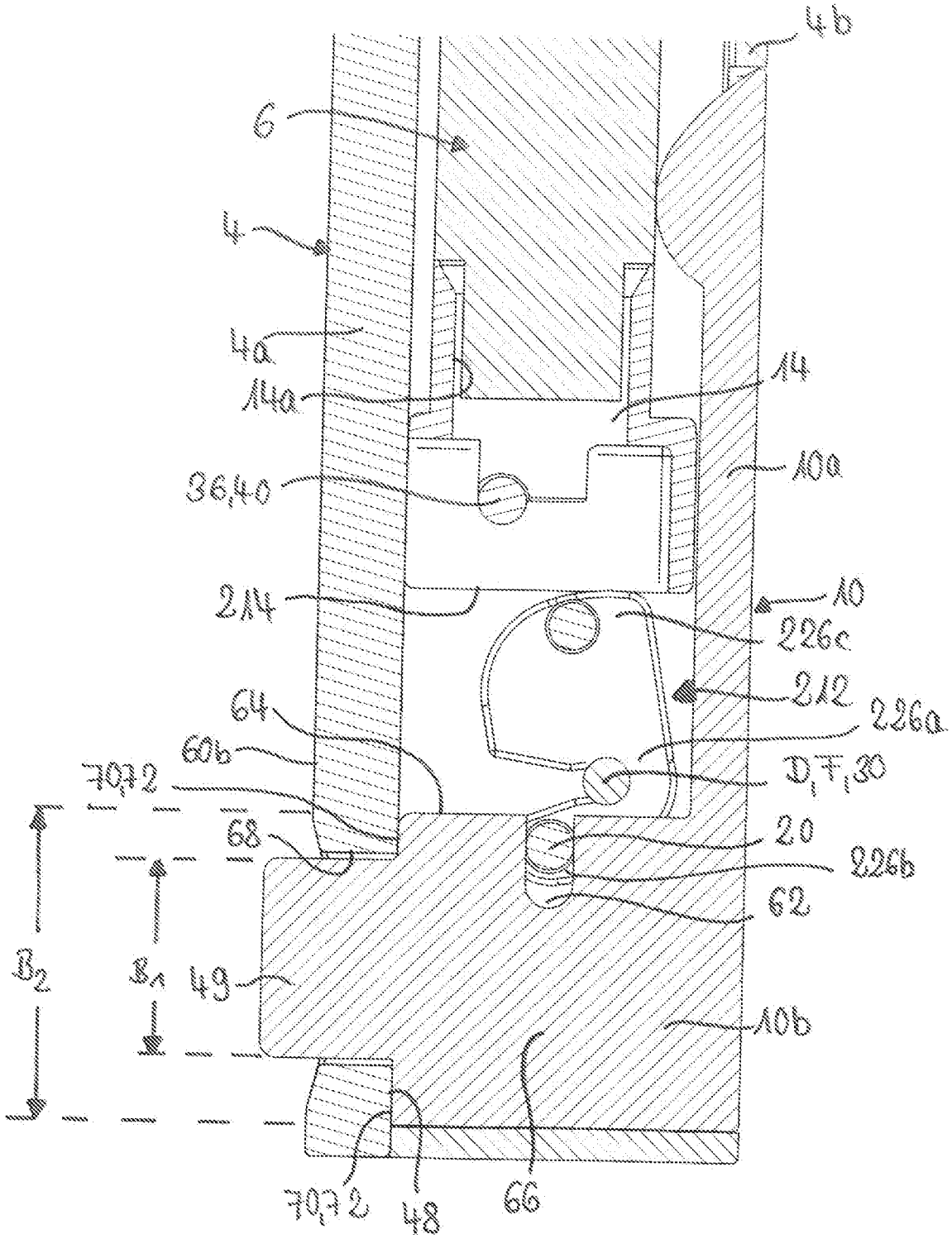
FIG. 17 shows a partial detail of a pen according to a further embodiment in the active position.

Further components of the pen 2 of the exemplary embodiment according to FIGS. 16 and 17 correspond to those of the exemplary embodiment with a connecting element 12 having two connecting members 12*a*, 12*b*, and therefore they are provided with the same reference signs and reference is made in this respect to the statements above.

REFERENCE SIGNS

2 Pen
4 Shaft
4*a* First shaft part
4*b* Second shaft part
4*c* Third shaft part
6 Core
6*a* Reservoir
6*b* Writing ball
6*c* Writing tip
8*a,b* Retaining elements
10 Actuating element
10*a* First longitudinal portion of the actuating element
10*b* Second longitudinal portion of the actuating element
12, 112, 212 Connecting element
12*a*, 112*a* First connecting member
12*b*, 112*b* Second connecting member
14, 114 Guide element
14*a*,114*a* Receptacle of the guide element
14*b*, 114*b* Outer peripheral surface of the guide element
16 Spring
16*a* First end of the spring
16*b* Second end of the spring
18 Front end side of the core
20, 120 Web
22, 122 Joint
24, 124 Clearance
26*a*, 126*a* Central portion of the first connecting member
26*b*, 126*b* First end portion of the first connecting member
26*c*, 126*c* Second end portion of the first connecting member
28*a*, 128*a* Second end portion of the second connecting member
28*b*, 128*b* First end portion of the second connecting member
30, 130 Connecting element
32, 132 Clearance
34, 134 Through-hole
36, 136 Guide means
38 Clearance
40, 140 Connecting element
42 Through-hole
44 Through-hole
46 Guide means
48 Inner peripheral surface of the shaft
49 Free end of the actuating element
50 Projection
52 Lateral surface of the actuating element
54 Receptacle
56 Projection
58 End portion of the actuating element
60*a* First lateral surface of the shaft 4
60*b* Second lateral surface of the shaft 4
62 Clearance
64 Front end side of the actuating element
66 Central portion of the actuating element
68 Clearance
214 Rear end side of the guide element
226*a* Central portion of the connecting element 212
226*b* First end portion of the connecting element 212
226*c* Second end portion of the connecting element 212
L Longitudinal direction of the shaft
S Pivot axis
D Axis of rotation
B Movement direction of the actuating element
F Fixed point
C Overhang of the core
$B_1$ Width of the free end of the actuating element
$B_2$ Width of the central portion of the actuating element

The invention claimed is:

1. A pen for writing and/or drawing purposes, the pen comprising:

a shaft having a front end;

a core disposed within said shaft and axially adjustable in a longitudinal direction of said shaft between an active position and an inoperative position, said core being disposed completely within said shaft in the inoperative position and protrudes with an overhang from said front end of said shaft in the active position;

a connecting element;

an actuating element being movable perpendicularly to the longitudinal direction of said shaft between an active position and an inoperative position and which is operatively connected to said core via said connecting element in such a way that, during a movement of said actuating element perpendicularly to the longitudinal direction of said shaft between the inoperative position and the active position, said core is axially adjustable in the longitudinal direction of said shaft; and said connecting element having a first end portion, a second end portion and a central portion and being rotatably mounted on said shaft in said central portion, said first end portion of said connecting element being mounted on said actuating element, and said second end portion of said connecting element being mounted directly or indirectly on said core.

2. The pen according to claim 1, wherein:

said connecting element is of a one-part design; or said connecting element has at least two connecting members which are each connected to one another in an articulated manner.

3. The pen according to claim 2, further comprising a guide element for guiding said core that is disposed within said shaft between said core and said connecting element, said guide element is axially adjustable in the longitudinal direction and has a receptacle for receiving a rear end portion of said core; and wherein said connecting element or one of said two connecting members is mounted on said guide element.

4. The pen according to claim 1, wherein:

said shaft has a first lateral surface and a second lateral surface; and in the inoperative position, said actuating element protrudes at least partially from said first lateral surface of said shaft and, in the active position, protrudes at least partially from said second lateral surface of said shaft that is opposite to said first lateral surface.

5. The pen according to claim 4, wherein said actuating element has a first longitudinal portion which extends in the longitudinal direction of said shaft and a second longitudinal portion which extends perpendicularly to the longitudinal direction and which is disposed at least partially within said shaft, wherein, in the inoperative position, at least said first longitudinal portion protrudes from said first lateral surface of said shaft and, in the active position, said second longitudinal portion protrudes by way of a free end at least partially from said second lateral surface of said shaft that is opposite to said first lateral surface.

6. The pen according to claim 5, wherein:

said shaft has a clearance formed therein;

said free end of said second longitudinal portion of said actuating element has a smaller width than an adjoining central portion of said second longitudinal portion; and said free end is at least partially disposed in said clearance of said shaft.

7. The pen according to claim 1, wherein said actuating element has at least one stop surface which interacts with an inner peripheral surface of said shaft in the active position and/or inoperative position.

8. The pen according to claim 1, wherein said actuating element has a clearance formed therein in which said first end portion of said connecting element is mounted.

9. The pen according to claim 8, wherein starting from a front end side of said actuating element, said clearance at least partially extends into said actuating element in the longitudinal direction of said shaft, and said first end portion of said connecting element is movably mounted in said clearance.

10. The pen according to claim 1, further comprising a locking and/or latching device, said core can be fixed in the active position and/or in the inoperative position by said locking and/or latching device.

11. The pen according to claim 10, wherein:

said connecting element has a first and a second connecting member; and said locking and/or latching device is formed by a joint which connects said first and said second connecting member of said connecting element.

12. The pen according to claim 1, further comprising at least one guide for guiding said connecting element and/or said actuating element in said shaft during a movement of said actuating element and of said core.

13. The pen according to claim 12, wherein:

said actuating element has a lateral surface with at least one receptacle formed in said lateral surface and extending perpendicular to the longitudinal direction; and said guide for guiding said actuating element in said shaft during a movement of said actuating element includes at least one projection which protrudes from an inner peripheral surface of said shaft, extends perpendicularly to the longitudinal direction of said shaft and interacts in a sense of a sliding pair with said at least one receptacle.

14. The pen according to claim 13, wherein:

wherein said actuating element has a first longitudinal portion and an end portion; and said receptacle is formed by a projection which protrudes from said lateral surface of said actuating element and extends perpendicularly to the longitudinal direction starting from said first longitudinal portion and at least partially along said lateral surface, and by said end portion of said actuating element, which projects with an overhang beyond said lateral surface.

15. The pen according to claim 13, wherein:

said actuating element has a first longitudinal portion which extends in the longitudinal direction of said shaft and a second longitudinal portion which extends perpendicularly to the longitudinal direction and which is disposed at least partially within said shaft; and said receptacle is formed by a projection which protrudes from said lateral surface of said second longitudinal portion of said actuating element, and extends perpendicularly to the longitudinal direction starting from said first longitudinal portion and at least partially along said lateral surface, and by said second longitudinal portion of said actuating element, which projects with an overhang beyond said lateral surface.

16. The pen according to claim 1, wherein:

said actuating element has a first longitudinal portion which extends in the longitudinal direction of said shaft and a second longitudinal portion which extends perpendicularly to the longitudinal direction and which is disposed at least partially within said shaft; and said second longitudinal portion of said actuating element has a clearance formed therein in which said first end portion of said connecting element is mounted.

17. The pen according to claim 16, wherein starting from a front end side of said second longitudinal portion of said actuating element, said clearance at least partially extends into said actuating element in the longitudinal direction of said shaft, and said first end portion of said connecting element is movably mounted in said clearance.

* * * * *